US010099507B2

(12) United States Patent
Grison

(10) Patent No.: US 10,099,507 B2
(45) Date of Patent: Oct. 16, 2018

(54) PAINT ROLLER REMOVAL TOOL

(71) Applicant: Michell R Grison, Victoria (CA)

(72) Inventor: Michell R Grison, Victoria (CA)

( * ) Notice: Subject to any disclaimer, the term of this patent is extended or adjusted under 35 U.S.C. 154(b) by 437 days.

(21) Appl. No.: 14/882,344

(22) Filed: Oct. 13, 2015

(65) Prior Publication Data

US 2017/0100959 A1 Apr. 13, 2017

(51) Int. Cl.
*B44D 3/00* (2006.01)

(52) U.S. Cl.
CPC ..... *B44D 3/006* (2013.01)

(58) Field of Classification Search
CPC ..... B44D 3/006; B05C 17/0245
See application file for complete search history.

(56) References Cited

U.S. PATENT DOCUMENTS

| | | | |
|---|---|---|---|
| 2,825,916 | A | 5/1955 | Basala, Jr. |
| 2,961,683 | A | 11/1960 | Meyer |
| 3,019,467 | A | 2/1962 | Garrett |
| 3,608,120 | A | 9/1971 | Seiler |
| 4,287,631 | A | 9/1981 | Marrs |
| 4,667,361 | A | 5/1987 | Wolcott et al. |
| 4,985,974 | A | 1/1991 | Fivecoate |
| 4,995,749 | A | 2/1991 | Gornik |
| 5,283,923 | A | 2/1994 | Schaedel |
| 5,335,392 | A | 8/1994 | Evans |
| 5,515,567 | A | 5/1996 | Washburn |
| 6,125,497 | A | 10/2000 | Galbreath |
| 6,829,803 | B2 | 12/2004 | Hutchinson |
| 2005/0273964 | A1 | 12/2005 | Hobbs |
| 2006/0064836 | A1 | 3/2006 | Mowe |

FOREIGN PATENT DOCUMENTS

| | | |
|---|---|---|
| GB | 2445235 | 10/2010 |

*Primary Examiner* — Shay Karls
(74) *Attorney, Agent, or Firm* — Island IP Law; Stephen R. Burri

(57) ABSTRACT

A paint roller removal tool has two semi-cylindrical portions and a hinge connecting them to form a cylinder in the closed position. By squeezing the cylinder, over top of a paint roller cover, first and second inner rings engage the roller cover to remove paint as the paint roller removal tool is moved from one end to another. One, two, three or more passes can be made to remove paint from the roller cover. Squeezing the cylinder further allows firm gripping of the roller cover to enable it to be removed from the paint roller frame and/or attached to the paint roller frame without a hand ever touching the roller cover.

10 Claims, 10 Drawing Sheets

PAINT ROLLER REMOVAL TOOL

TECHNICAL FIELD

The present invention relates to a tool for removing paint from paint rollers and for removing paint roller covers from paint roller frames.

CROSS REFERENCE TO RELATED APPLICATIONS

None.

GOVERNMENT SUPPORT

None.

BACKGROUND

It is common to use paint rollers to apply paint to walls and other surfaces. When the job of painting is finished for the day, if paint is left on a roller the paint will harden on the roller and make the roller unusable in the future. If paint is properly removed from a paint roller then the paint can be saved and the roller can be reused in the future.

Removing paint from paint rollers is an onerous task which if not performed properly will result in paint left on the roller and render the roller useless. Cleaning paint rollers can be time consuming, messy and difficult to perform properly.

Paint rollers are often used to spread paint quickly and evenly. Paint rollers typically comprise a paint roller cover which accepts paint and a roller frame which accepts the cover. There exist paint roller covers of different lengths, sizes and materials and with different diameter thicknesses. For example, some roller covers can be made of nylon, polyester, lamb's wool, molhair, and/or foam or other material.

Roller covers are available with different fiber lengths, sometimes called nap length, that effectively change the outer diameter of the roller cover. Nap lengths of ⅛ inch or ¼ inch can be used for painting smooth surfaces like plaster. A ⅜ inch nap may be used for painting textured surfaces like drywall, and a ¾ inch nap may be used for painting textured surfaces like stucco and brick.

There exists a need for an easy and efficient way to remove paint from rollers of various sizes, and to remove paint roller covers from paint roller frames without getting paint on the user's hands.

SUMMARY OF INVENTION

A paint roller removal tool has first and second semi-cylindrical portions and a hinge connecting them together. First and second inner rings, connected to the first and second semi-cylindrical portions, have inner diameters when the first and second semi-cylindrical portions are closed together, that are about the diameter of a roller cover with a zero nap.

The inner diameters may be between 1.5 and 1.75 inches long or, more preferably, about 1 and ⅝ inches long.

The hinge can be a living hinge that biases the first and second semi-cylindrical portions to an open position.

The second inner ring can have apertures therein to permit a small amount of paint to pass therethrough.

The paint roller removal tool itself can have a longitudinal length of between 2 and 6 inches long, or more preferably between 4 and 5 inches long and more preferably between 4 and 4.5 inches long.

There can be a gap between the first inner ring and a nearest edge of the paint roller removal tool, which can be between ¼ and 1 inch long or more preferably about ¾ inch long. There can also be a gap between the second inner ring and a nearest edge of the paint roller removal tool, which can be between ¼ and 1 inch long or more preferably about ¾ inch long.

A method of using a paint roller removal tool to remove paint from a paint roller cover can involve placing a hand around an outer surface of the paint roller removal tool, positioning the paint roller removal tool at a first end of the paint roller cover, squeezing the first and second semi-cylindrical portions together, pulling the paint roller removal tool down to a second end of the paint roller cover thereby transferring paint from the paint roller cover to the paint roller removal tool, and emptying the paint from the paint roller removal tool into a paint can.

The method can further involve repeating the process as required until the roller cover is clean. The roller cover can then be removed by squeezing the paint roller removal tool a little harder to firmly grip the roller cover and remove it from the paint roller frame.

BRIEF DESCRIPTION OF DRAWINGS

In figures which illustrates aspects of non-limiting embodiments of the invention.

DESCRIPTION

Figure 1:
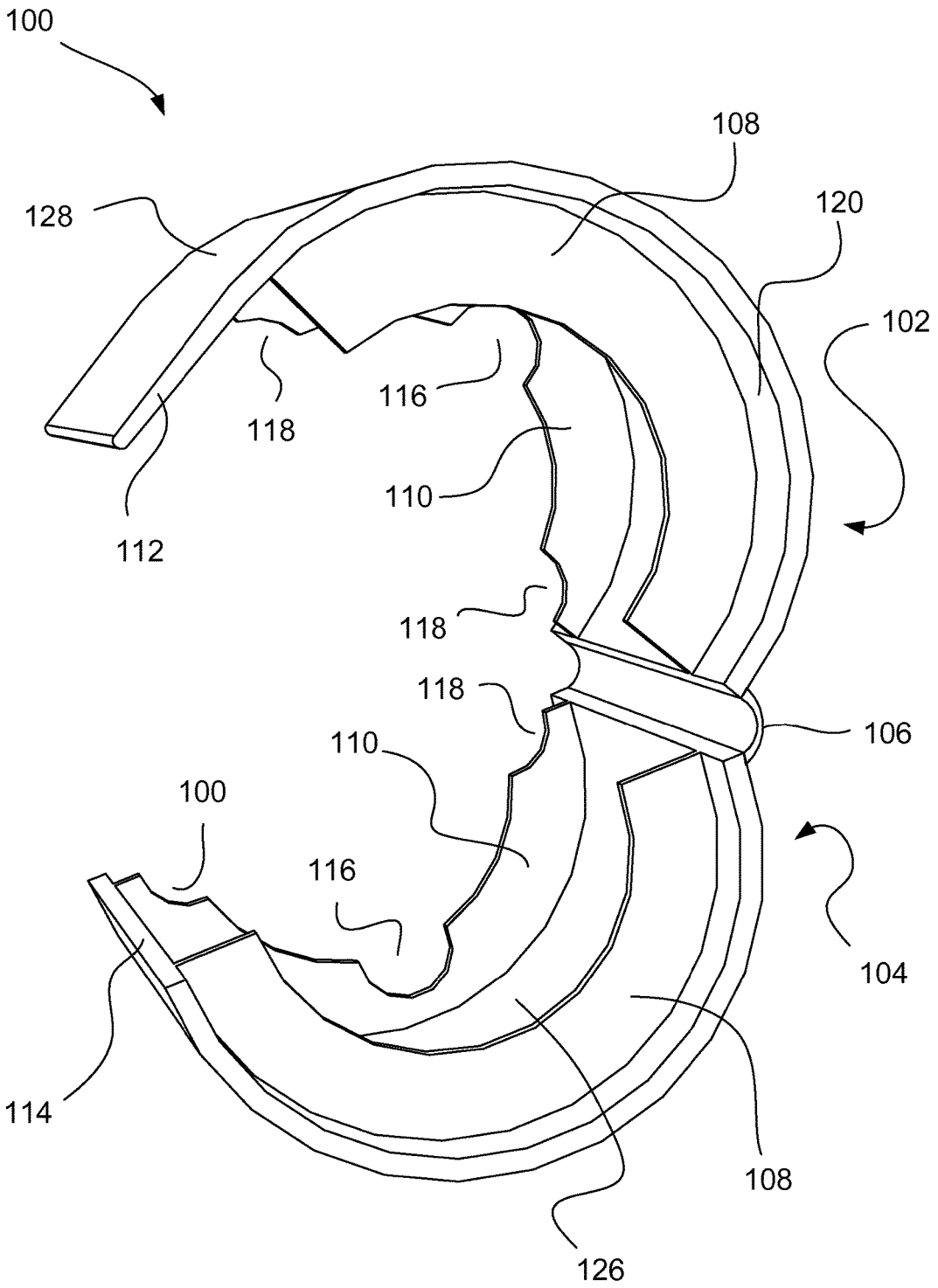
FIG. 1 is a perspective view of an embodiment of this invention in an open position.
Figure 2:
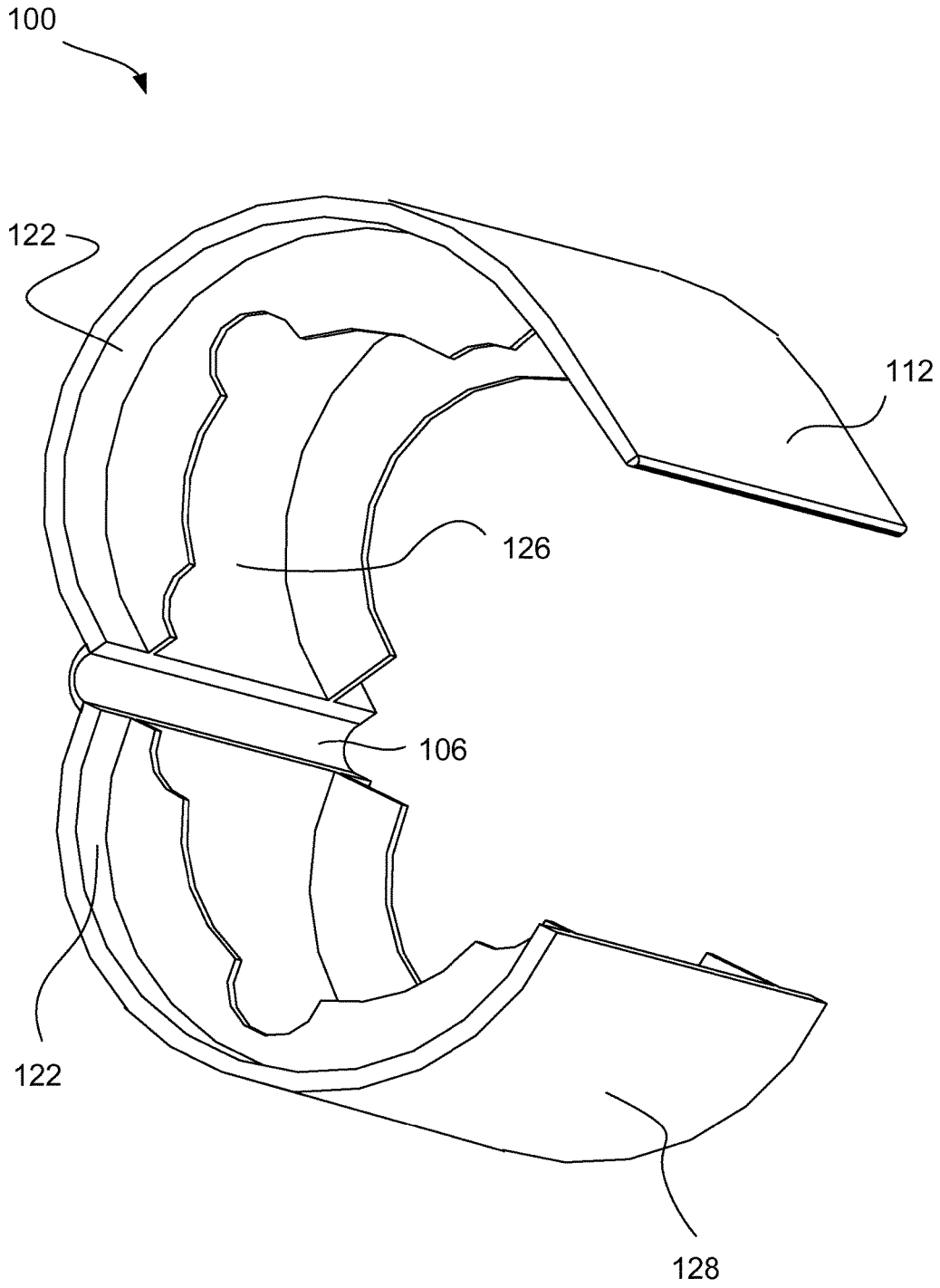
FIG. 2 is a second perspective view of the embodiment of FIG. 1 in an open position.
Figure 3:
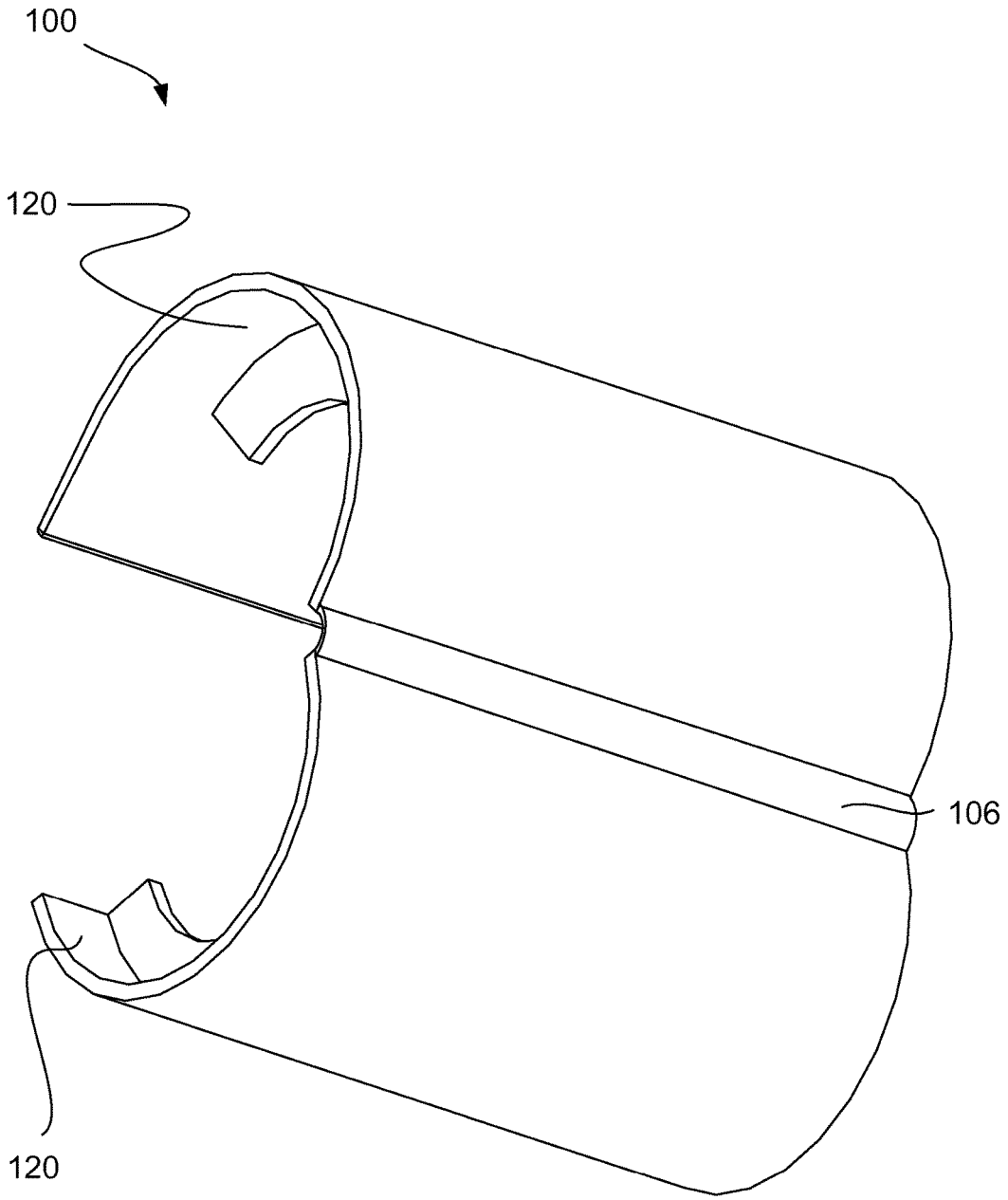
FIG. 3 is a third perspective view of the embodiment of FIG. 1 in an open position.
Figure 4:
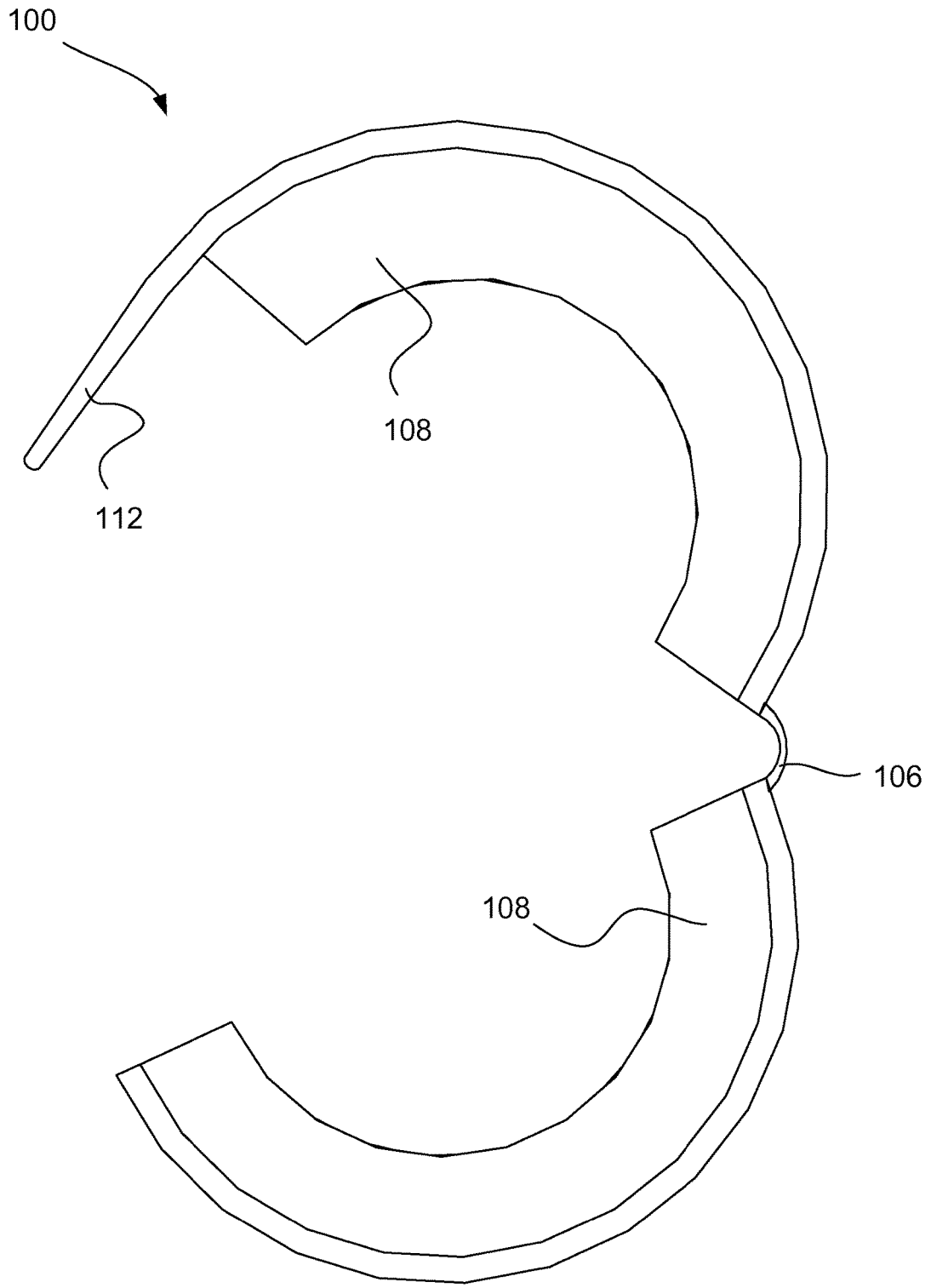
FIG. 4 is an end view of the embodiment of FIG. 1 in an open position.
Figure 5:
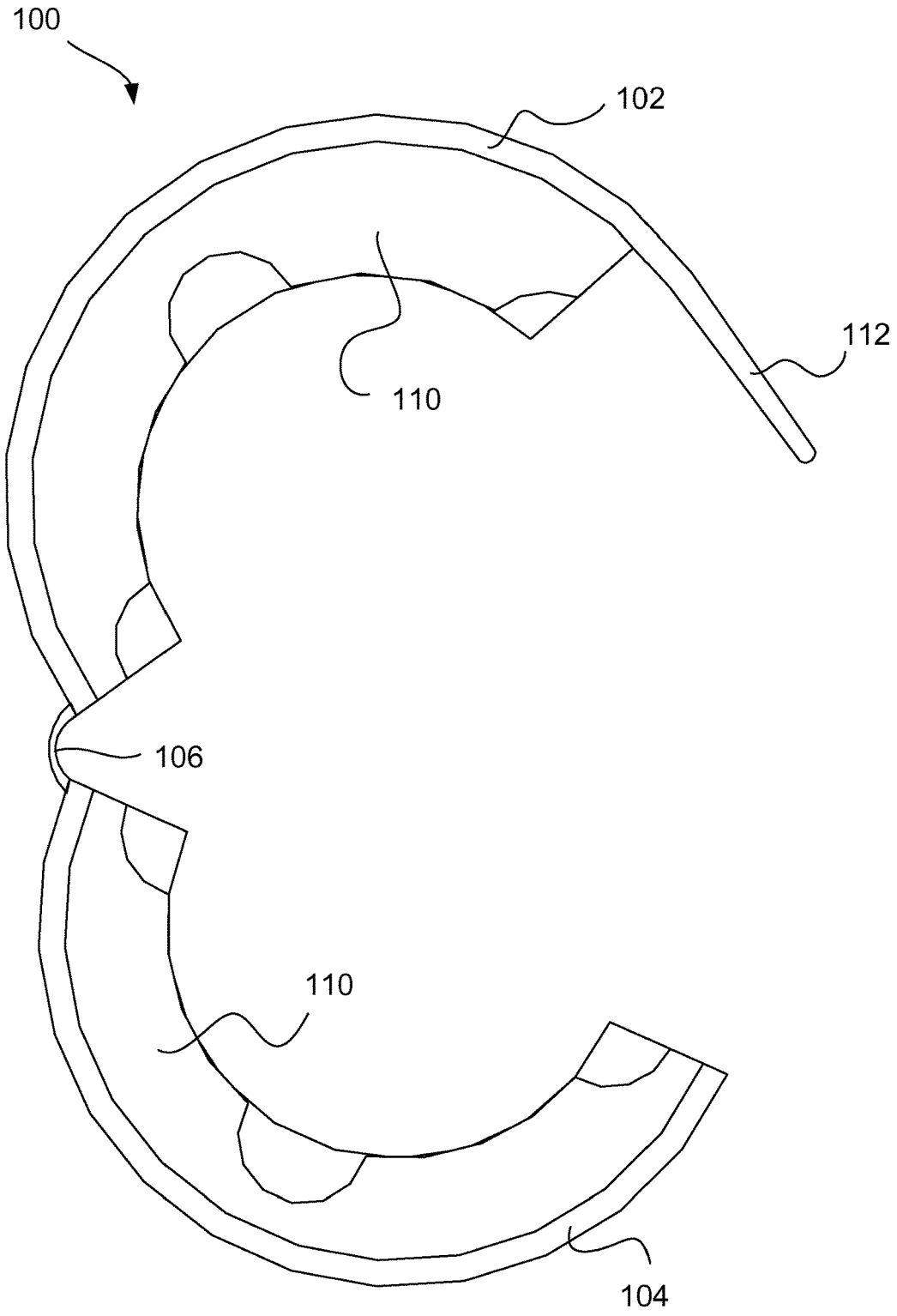
FIG. 5 is a second end view of the embodiment of FIG. 1 in an open position.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

With reference to the figures, embodiment 100 has a top semi-cylindrical portion 102 and a bottom semi-cylindrical portion 104 which are joined by a hinge 106, which is preferably a living hinge that biases portions 104 and 106 into an open position as shown in FIGS. 1-5.

Semi cylindrical portion 102 has a lip 112 that overhangs semi-cylindrical portion 104 when closed. Semi-cylindrical portion 104 has a blunt edge 114 which fits inside lip 112 when closed.

Figure 6:
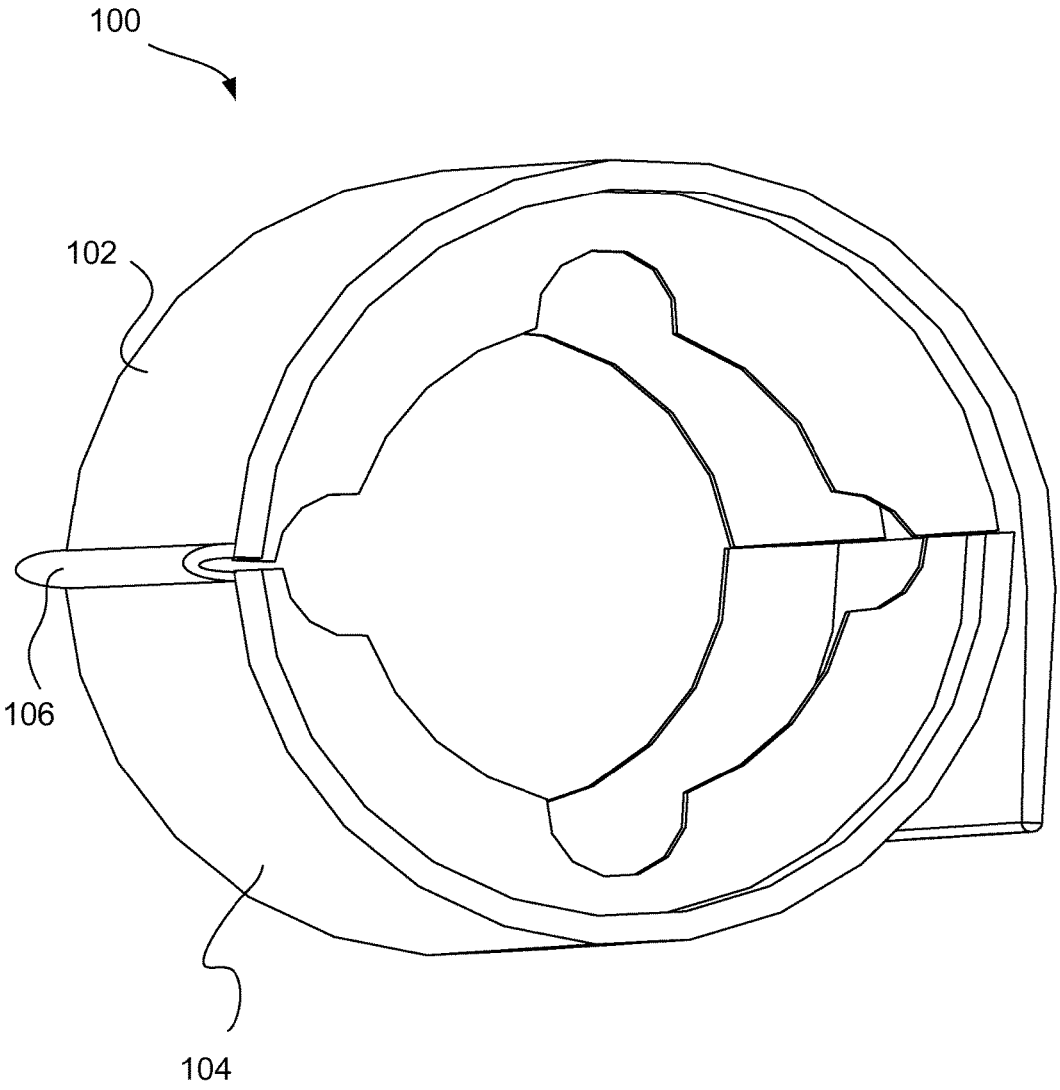
FIG. 6 is a perspective view of the embodiment of FIG. 1 in a closed position.
Figure 7:
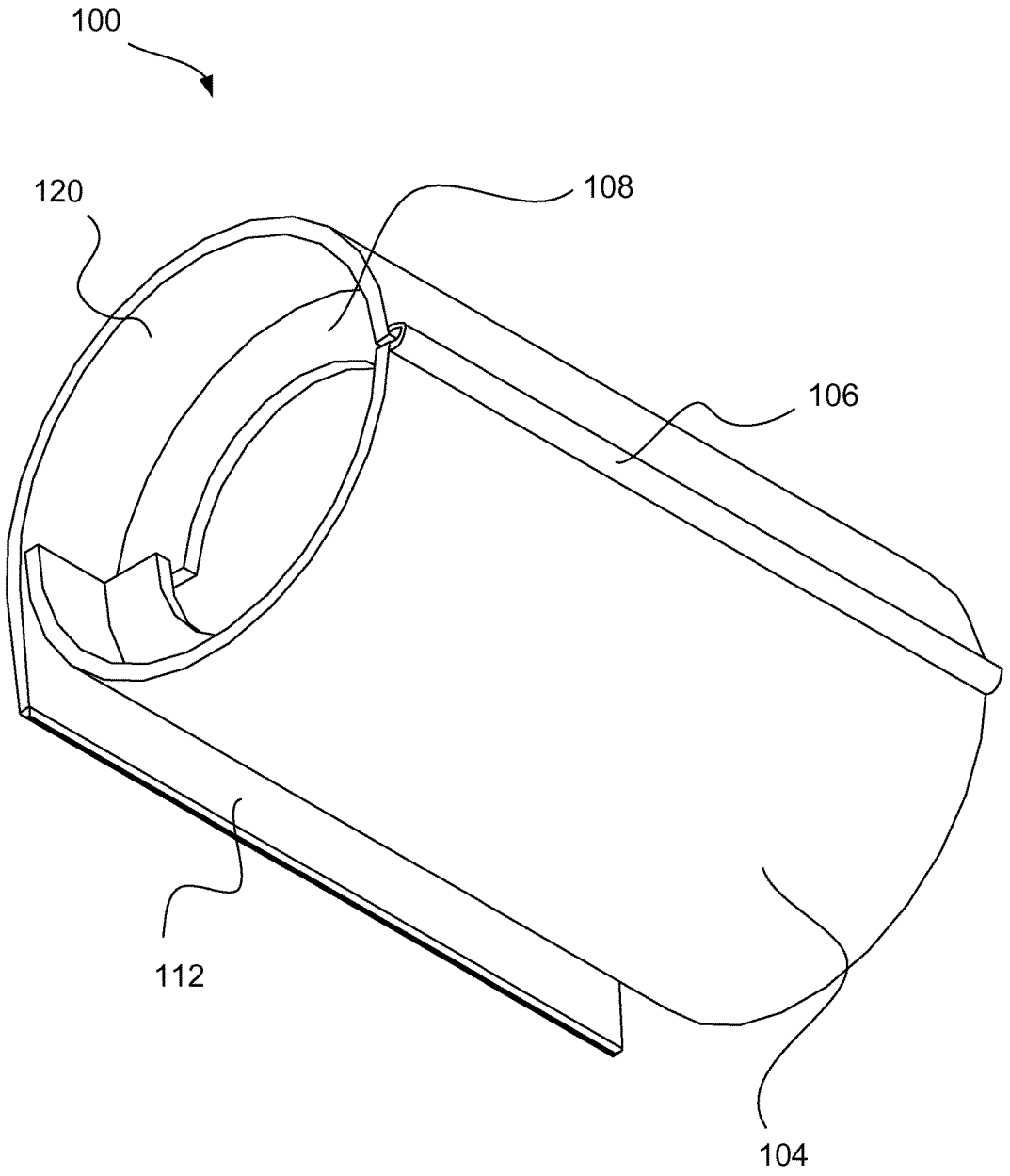
FIG. 7 is a second perspective view of the embodiment of FIG. 1 in a closed position.
Figure 8:
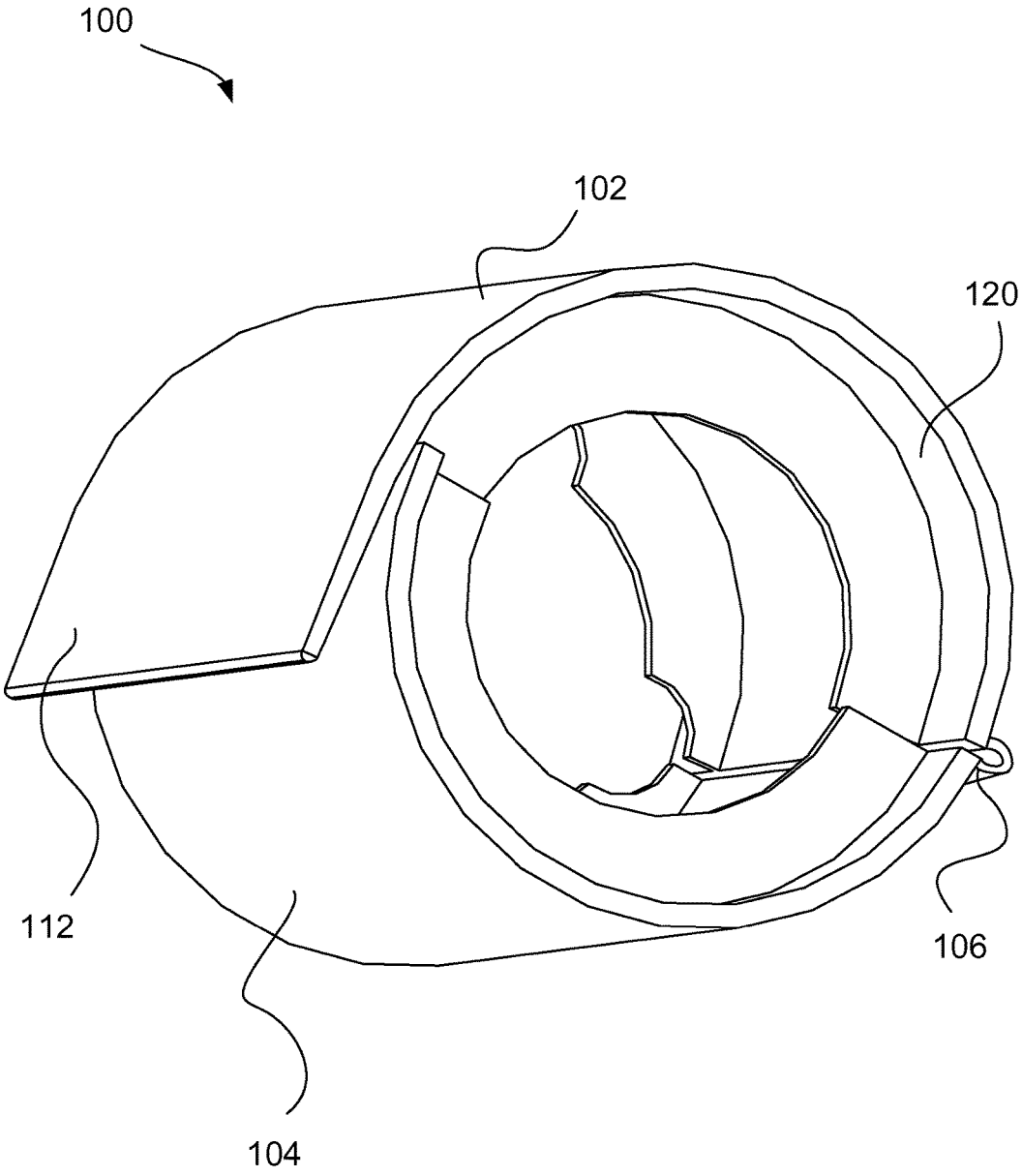
FIG. 8 is a third perspective view of the embodiment of FIG. 1 in a closed position.

When closed, as shown in FIGS. 6-8, the semi-cylindrical portions 104 and 106 together form a cylinder. Embodiment 100 has a first inner ring 108 and a second inner ring 110. Inner ring 110 has apertures 116 and 118 formed therein.

Inner ring 108 is set back a distance 120 from the outer edge of embodiment 100 and inner ring 110 is set back a distance 122 from the outer edge of embodiment 100.

In operation, a user's hand holds embodiment 100 on its outer surface 128. Any paint removed from a roller stays on the inner rings 108 and 110 and/or on inner surface 126 to keep paint off the user's hand.

As shown in the cross-sectional view 124 of embodiment 100 the inner rings 108 and 110 are formed by semi-circular portions 108A and 110A attached to portion 102 and semi-circular portions 108B and 110B attached to portion 104. Semi-circular portions 108A and 108B can be offset, and semi-circular portions 110A and 110B can be offset as shown in the closed position in FIG. 9.

Figure 9:
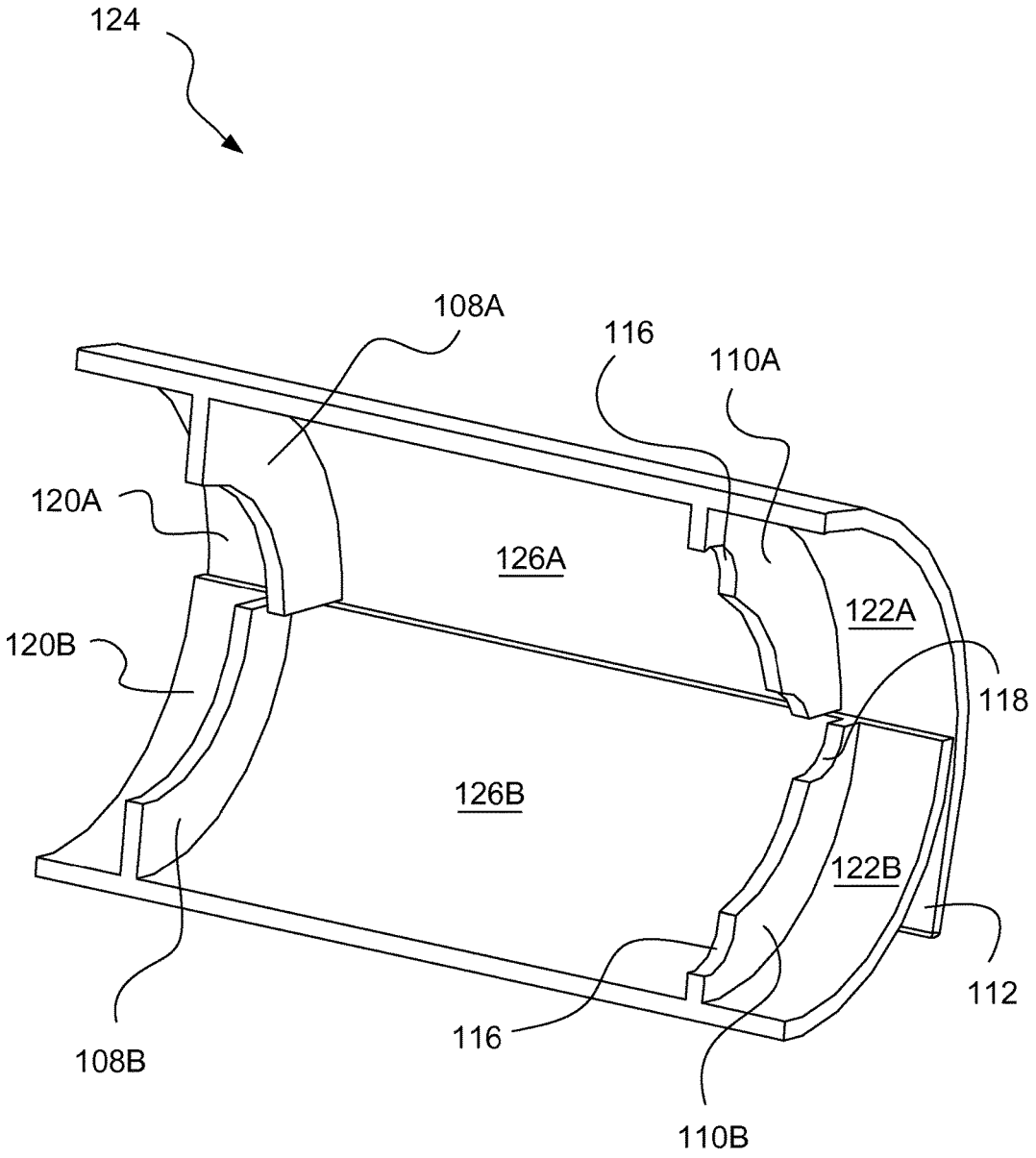
FIG. 9 is a cross-section perspective view of the embodiment of FIG. 1 in a closed position.

The distances 120A and 120B that semi-circular portions 110A and 110B are set back from the edge of embodiment 100 are clearly shown in FIG. 9. In embodiment 100, distance 120A is slightly greater than distance 120B, which results in the offsetting of semi-circular portions 110A and 110B. In embodiment 100, distance 122A is slightly greater than distance 122B, which results in the offsetting of semi-circular portions 108A and 108B.

The inner diameter of inner rings 108 and 110 are chosen to fit snugly on a roller cover with a small nap, such as ⅛ inch, when embodiment 100 is fully closed. For use with larger diameter roller covers, such as with larger nap sizes, embodiment 100 can still be effectively used, it merely doesn't close quite as far.

Figure 10:
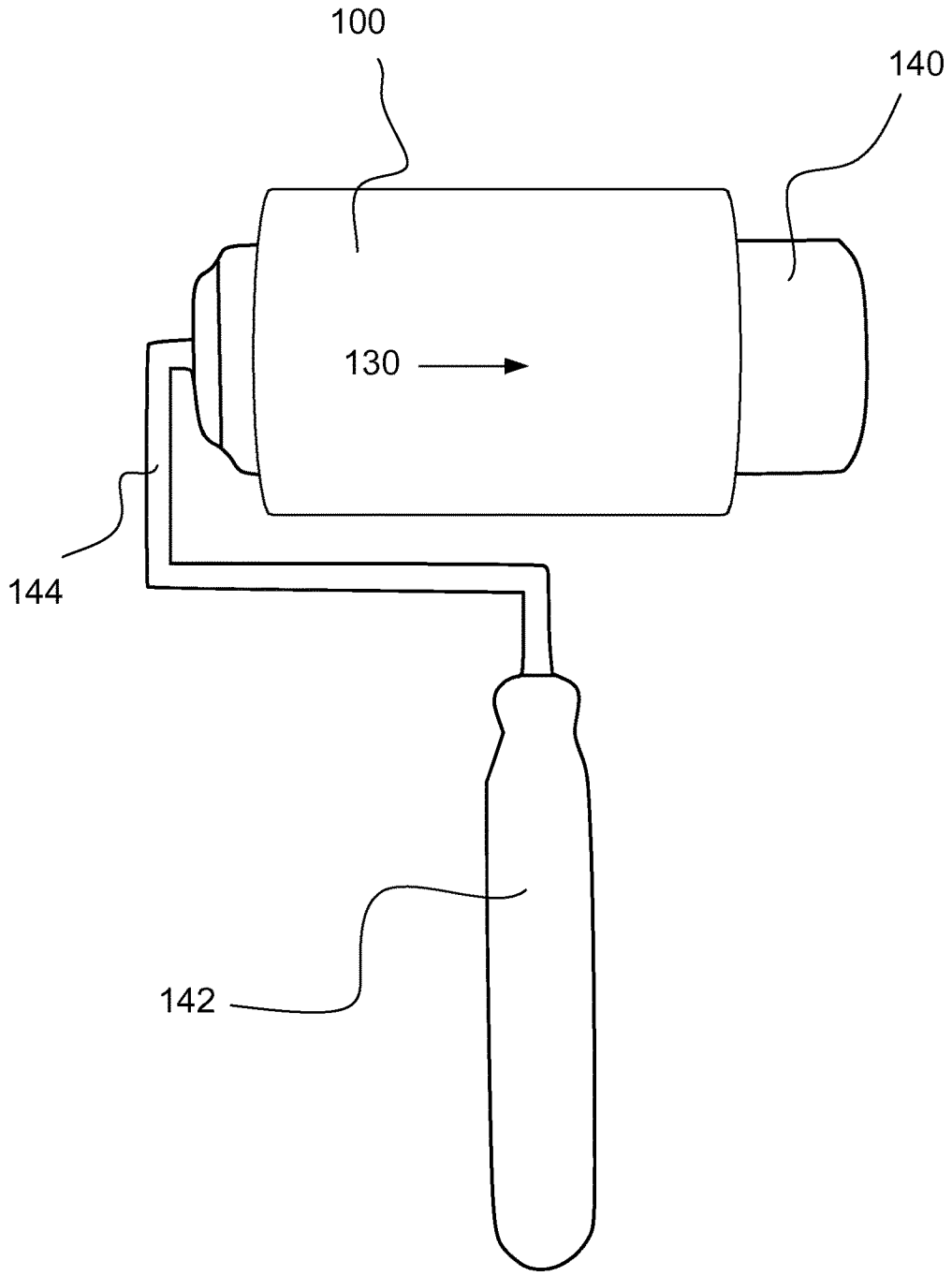
FIG. 10 is a top view of an embodiment of the invention shown with a paint roller.

In operation to remove paint from a roller cover 140, embodiment 100 is placed over the paint roller as shown in FIG. 10 and a user's hand squeezes around the outer surface 128 of embodiment 100, moving it from the end of the roller cover 140 near the roller wire frame 144 to the opposite end of the roller cover 140 in direction 130 to remove paint from roller cover 140. One of the user's hands can be on paint roller handle 142 while the other is on the outer surface 128 of embodiment 100. Both hands can remain paint free as paint is removed from the roller. Optimally embodiment 100 is positioned such that inner ring 110 passes down the roller cover 140 first with inner ring 108 following as embodiment 100 is moved in direction 130.

After one, two, three or more passes, the paint will be removed and roller cover 140 will be clean. Roller cover 140 can be removed by the user by further squeezing together embodiment 100 to firmly grip the roller cover 140 and remove it from the roller wire frame. Similarly the roller cover 140 can be attached to the roller frame in the same manner without having to touch roller cover 140 at any time with the user's hands.

The apertures 116 and 118 allow more fluid motion of the tool in operation as it moves down the roller cover 140. It is to be understood that the apertures can vary in size and spacing and yet not depart from the scope or spirit of the invention.

The distances 120 and 122 that set back inner rings 108 and 110 from the edge of the paint removal tool may accept paint that runs off the inner rings 108 and 110 thereby significantly reducing or completely eliminating paint getting on the outer surface 128 when the tool is used in normal operation. These distances 120 and 122 thereby protect the user's hand from getting paint on it.

The lip 112 further keeps paint within the body of embodiment 100 instead of spreading elsewhere or getting on the user's hand. When the tool is used to remove paint from a roller cover 140 with a small nap, such as a ⅛ inch nap, the semi-circular portions 102 and 104 are closed closely together. When embodiment 100 is used to remove paint from a roller cover 140 with a larger nap, such as ¾ inch nap, the semi-circular portions 102 and 104 are further apart when the tool is closed on the roller cover 140 but the lip 112 keeps paint from otherwise escaping. The inside surface 126A has an effectively larger surface area exposed to paint, due to lip 112, when embodiment 100 is partially open. The inside surface 126B on semi-circular portion 104 always stays the same.

It will be appreciated by persons skilled in the art that the present invention is not limited by what has been particularly shown and described herein. Rather the scope of the present invention includes both combinations and sub-combinations of the features described herein as well as modifications and variations thereof which would occur to a person of skill in the art upon reading the foregoing description and which are not in the prior art. Furthermore, many alterations and modifications are possible in the practice of this invention without departing from the spirit or scope thereof. Accordingly, the scope of the invention is to be construed in accordance with the substance defined by the following claims.

What is claimed is:

1. A paint roller removal tool comprising a first semi-cylindrical portion; a second semi-cylindrical portion; a lip extending from said first semi-cylindrical portion such that in the closed position said lip extends overtop of said second semi-cylindrical portion; a hinge hingedly connecting said first semi-cylindrical portion to said second semi-cylindrical portion, wherein said hinge is a living hinge that biases said first and second semi-cylindrical portions to an open position; a first inner ring connected to said first and second semi-cylindrical portions; and a second inner ring connected to said first and second semi-cylindrical portions; apertures on said second inner ring to permit a small amount of paint to pass therethrough; a first gap between said first inner ring and a nearest edge of said paint roller removal tool; and a second gap between said second inner ring and a second edge of said paint roller removal tool; offsetting a first half of said first inner ring and a second half of said first inner ring.

2. The paint roller removal tool of claim 1 offsetting a first half of said second inner ring and a second half of said second inner ring.

3. The paint roller removal tool of claim 2 wherein a longitudinal length of said paint roller removal tool is between 2 and 6 inches long.

4. The paint roller removal tool of claim 2 wherein a longitudinal length of said paint roller removal tool is between 4 and 5 inches long.

5. The paint roller removal tool of claim 4 wherein the diameter of said first inner ring is between 1.5 and 1.75 inches long.

6. The paint roller removal tool of claim 5 wherein said first gap is between ¼ and 1 inch long.

7. The paint roller removal tool of claim 6 wherein said second gap is between ¼ and 1 inch long.

8. The paint roller removal tool, of claim 7 wherein said second gap is about ¾ inch long.

9. The paint roller removal tool of claim 5 wherein said first gap is about ¾ inch long.

10. The paint roller removal tool of claim 4 wherein the diameter of said first inner ring is about 1 and ⅝ inches long.

* * * * *